US005931348A

United States Patent [19]

Guadalupi

[11] Patent Number: 5,931,348

[45] Date of Patent: Aug. 3, 1999

[54] POST-MIX APPARATUS FOR BEVERAGE DELIVERING

[75] Inventor: Riccardo Guadalupi, Ponateranica, Italy

[73] Assignee: Vin Service S,r,I., Zanica, Italy

[21] Appl. No.: 09/080,725

[22] Filed: May 21, 1998

[30] Foreign Application Priority Data

Dec. 12, 1997 [EP] European Pat. Off. ..... 97830729

[51] Int. Cl.[6] ..... B67D 5/56

[52] U.S. Cl. ..... 222/129.1; 222/145.5

[58] Field of Search ..... 222/129.1, 145.5

[56] References Cited

U.S. PATENT DOCUMENTS 3,295,723 1/1967 Welty ..... 222/145.5
3,347,421 10/1967 Yingst et al. ..... 222/129.1
5,433,349 7/1995 Romanyszyn, Jr. ..... 222/145.5

FOREIGN PATENT DOCUMENTS 0 543 741 5/1993 European Pat. Off. .
0 837 029 4/1998 European Pat. Off. .
WO9117948 11/1991 WIPO ..... 222/145.5

*Primary Examiner*—Philippe Derakshani
*Attorney, Agent, or Firm*—Millen, White, Zelano, & Branigan, P.C.

[57] ABSTRACT

Apparatus for dispensing beverages, of the "post-mix" type, comprises at least one source of water, at least one reservoir containing syrup, one or more mixing and dispensing taps and a hydraulic connection. The hydraulic connection comprises at least one shaped block containing at least one longitudinal duct for the transport of water, one or more transversal ducts in fluid communication with each of the longitudinal ducts for tapping of water in correspondence with the mixing taps and one or more pipe fittings that communicate with the respectively transversal ducts.

16 Claims, 2 Drawing Sheets

POST-MIX APPARATUS FOR BEVERAGE DELIVERING

BACKGROUND OF THE INVENTION

FIELD OF THE INVENTION

The present invention relates to an apparatus for dispensing beverages, of the "post-mix" type, i.e. an apparatus that achieves the final mixing of syrup and water only at the moment of dispensing for consumption the same beverage.

"Post-mix" apparatuses for dispensing beverages, preset for dispensing different beverages, usually comprise a plurality of distribution points, each of which has a mixing tap fitted with electro-valves to regulate the flows, into which run two tubes bringing syrup (deriving from a related reservoir) and water respectively.

According to the beverage to be mixed, the water required might be natural or carbonated, therefore a source of natural water and a source of carbonated water is generally made available for each dispenser apparatus.

In some embodiments, however, there is a further tube in which refrigeration liquid circulates with the purpose of maintaining a low temperature of the water in the ducts. In other recent embodiments, this refrigeration function is carried out by the same carbonated water, which is recirculated for this purpose in a circuit comprising cooling means.

Each beverage distribution point requires that different liquids flow together e.g. cola syrup and carbonated water in one point, or orange syrup and natural water in another, and that means of continuous cooling of the water be available; this results in a rigid and relatively disordered arrangement of tubes which are difficult to install and modify.

In particular, when it is necessary to replace the tube of the natural water with that of the carbonated water, or vice versa, at a point of distribution, to the difficulty of reconfiguring the layout of the tubes is added the need to weld or cut, connect or disconnect the tubes linked to the main supply tubes of natural or carbonated water.

Another drawback of such apparatus consists in the difficulty of insulating the water tubes from, in particular, the sections linked to the dispensers, for the purpose of maintaining the temperature of the liquids low. Finally, condensation will form quite easily on the pipelines which transport the water at relatively low temperature.

OBJECTS OF THE INVENTION

An object of the present invention is to provide an apparatus for the instant dispensing of beverages of the "post-mix" type, which is inexpensive, allows the layout of the tubes connected to the mixing taps to be modified simply and is simple to insulate.

SUMMARY OF THE INVENTION

This object is achieved by the present invention, as claimed in the main claim, which relates to an apparatus for the instant dispensing of beverages, of the "post-mix" type, comprising at least one source of natural or carbonated water, at least one reservoir containing syrup, one or more mixing and dispensing taps and means of hydraulic connection respectively from the source or sources of water and from the reservoir or reservoirs of syrup to the taps. According to the invention, such means of hydraulic connection comprise a shaped block that contains at least a longitudinal duct for dispensing water, one or more transversal ducts in fluid communication with each longitudinal duct and pipe fittings connected with the transversal ducts and with the mixing taps respectively, so that a transversal duct and a pipe fitting is provided for each mixing tap.

According to a different aspect of the invention, the shaped block contains one or more transversal channels to dispense the syrup, separate from the longitudinal channels. Each of such transversal channels communicates with a corresponding pipe fitting that in turn communicates with the relative mixing tap.

According to a further aspect of the invention, at least two longitudinal channels are foreseen in the block, for dispensing natural water and carbonated water respectively, both communicating with at least one transversal channel and means for selectively controlling the dispensing of fluid alternatively from one or other channel to the corresponding pipe fittings corresponding to the transversal channel or channels for dispensing water.

In a further embodiment of the invention, the shaped block comprises a third channel for the transport of refrigerant liquid, to maintain the water circulating in the dispenser apparatus at a low temperature.

Some embodiments of the invention will be shown, by way of not limitative example, with reference to the attached drawings, in which:

DESCRIPTION OF THE PREFERRED EMBODIMENTS

Figure 1:
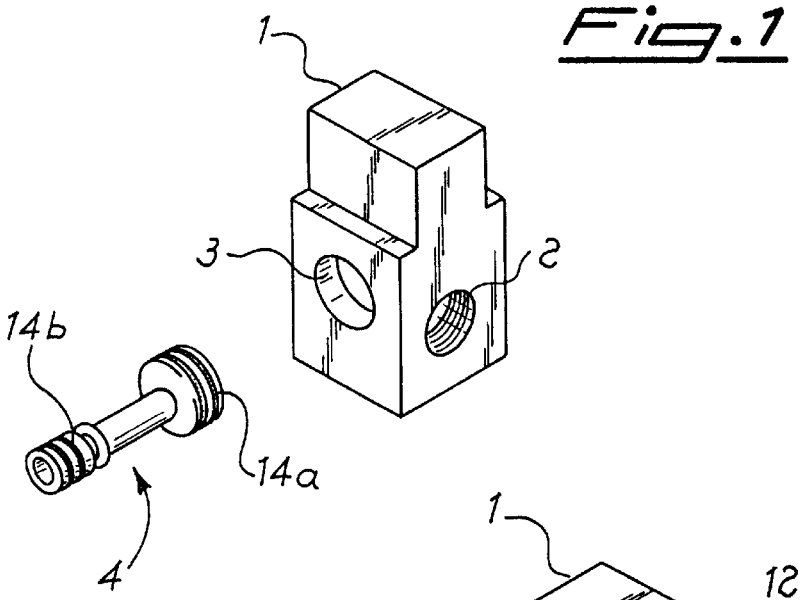
FIG. 1 is a partially exploded prospective view of the means of hydraulic connection of the invention according to a first, simpler, embodiment.

With reference to FIG. 1, the hydraulic connection means of the apparatus for dispensing "post-mix" beverages comprise a shaped block 1, in metal or plastic material, having a longitudinal duct 2 connected to a suitable source of water (not shown), a transversal duct 3 in hydraulic connection with the longitudinal duct 2 and a pipe fitting 4 to communicate partially with the transversal duct 3 and with a mixing top, not shown in the figure.

The pipe fitting 4, of the bayonet type, comprises in its turn sealing rings 14*a* and 14*b* at the extremities and is shaped for rapid insertion into the block 1 or into the mixing top, where the required syrup could arrive by other ways.

Figure 2:
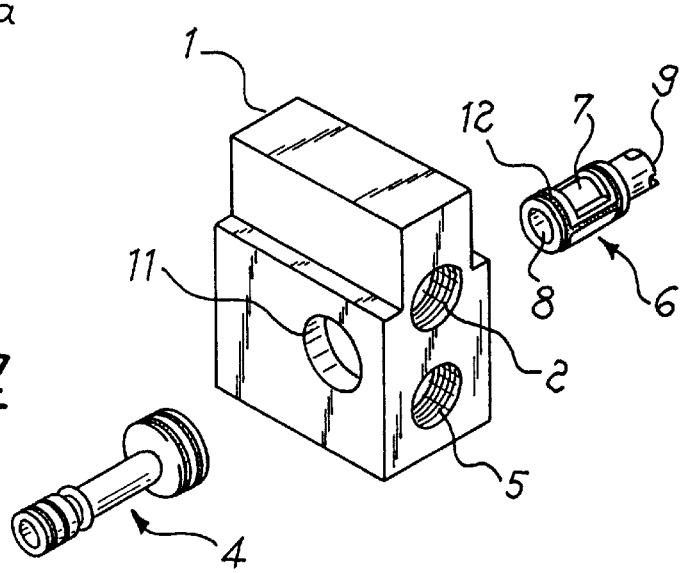
FIG. 2 is a partially exploded prospective view of the hydraulic connection means, according to a different aspect of the invention.

FIG. 2 shows a different embodiment of the invention, according to which leantwo longitudinal ducts 2 and 5 are provided for in the shaped block 1 for dispensing natural and carbonated water respectively. Such ducts 2 and 5 are interconnected with a transversal duct 11 which houses a pipe fitting 4, to dispense the water to the mixer tap, and a needle-valve selector 6.

The needle-valve 6 comprises a fluid entry aperture 7, located along the side wall and an axial exit aperture 8, located at the ends of an L-shaped internal parth within the same valve 6. Furthermore, this valve 6 presents external lateral gaskets 12 and a head 9 equipped with slots to allow an axial rotation of the same valve 6.

The dimensions of the valve 6, and in particular of the entry aperture 7, allow the passage to the inside of the same valve 6, of liquid deriving from one alone of the ducts 2 or 5, according to the position of the aperture 7 with respect to the ducts 2 and 5.

Figure 4:
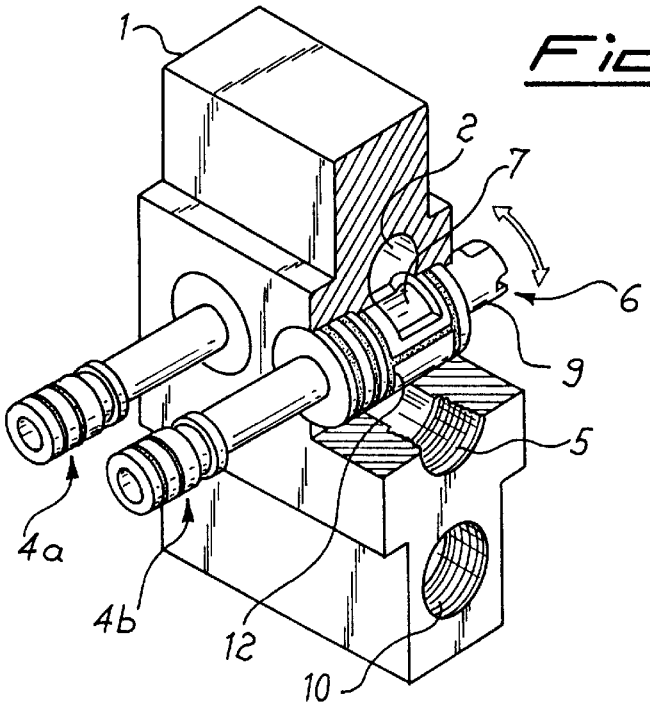
FIG. 4 is a cutaway prospective view of the means for hydraulic connection of the invention according to the embodiment of FIG. 3.

In other words axially, rotating the valve 6 within the seat defined by the transversal channel 11, as shown in detail in FIG. 4, the entry aperture 7 locates selectively in correspondence to the duct 5 or the duct 2, allowing alternatively influx of the liquid deriving from one of the ducts 2 or 5 into the transversal duct 11 and therefore into pipe fitting 4.

Figure 3:
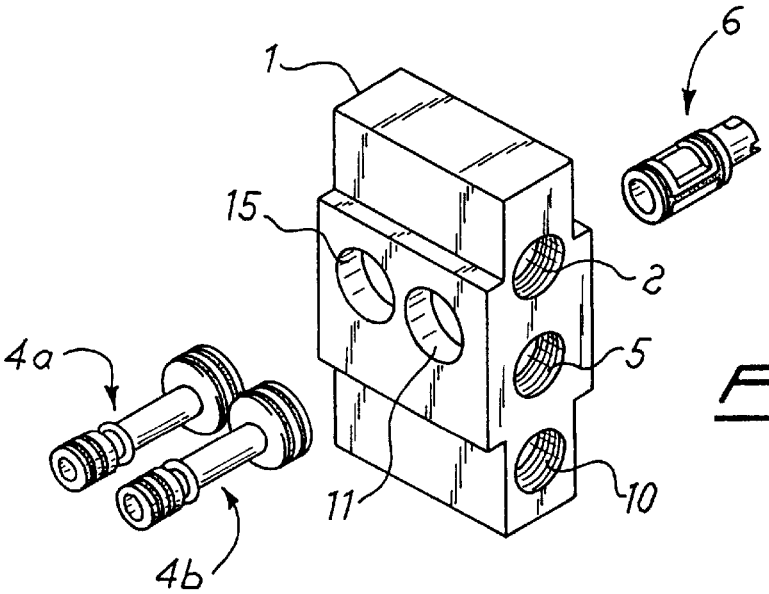
FIG. 3 is a partially exploded prospective view of the hydraulic connection means according to a further embodiment of the invention.
Figure 5:
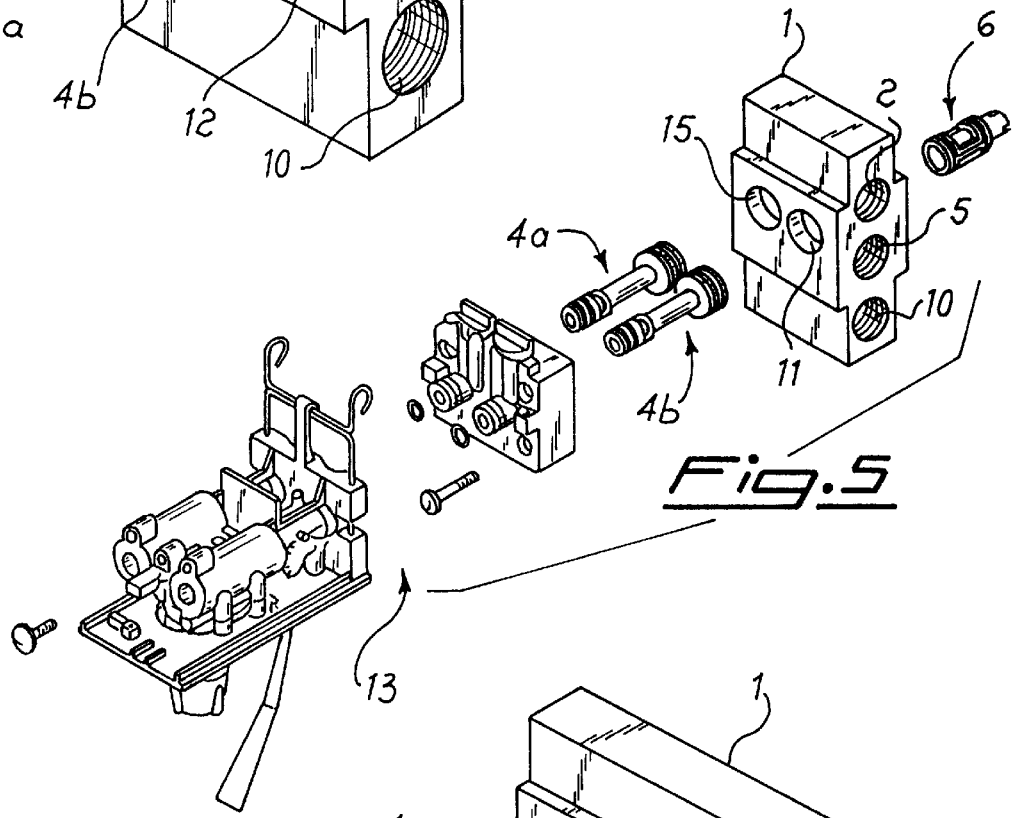
FIG. 5 is a partially exploded prospective view of the dispensing apparatus according to the embodiment of FIG. 3.
Figure 6:
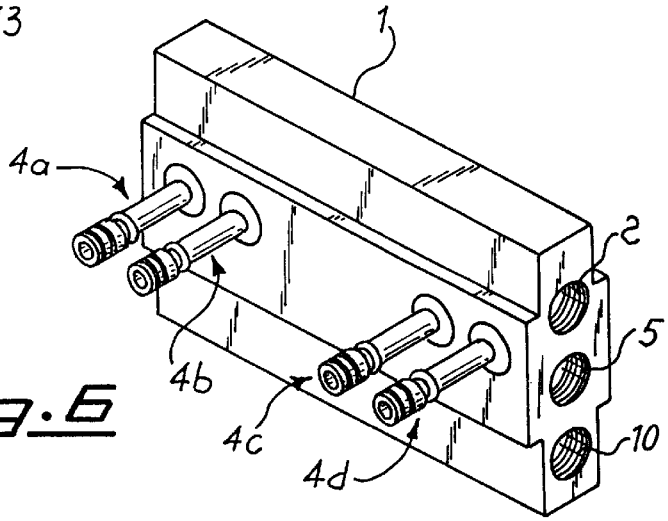
FIG. 6 is a prospective view of the hydraulic connection means of the invention predisposed for multiple dispenser points.

A further embodiment of the invention, illustrated in FIGS. 3 and 5, comprises three longitudinal ducts 2, 5 and 10, cut into the shaped block 1, for the passage of natural water, carbonated water and refrigeration liquid respectively, a first transversal duct 11 which communicates hydraulically alternatively with the water transport ducts 2 and 5 and houses a pipe fitting 4b and a needle-valve 6, as previously described, as well as a second transversal duct 15 separate from the longitudinal tubes 2, 5 and 10 to allow the influx of syrup deriving from a related reservoir (not shown) to the mixer tap 13 through a pipe fitting 4*a*. Finally FIG. 6 shows a partial view of the present invention, in the embodiment of FIGS. 3, 4 and 5, in which pipe fittings are provided for, necessary for two mixing taps and therefore for two beverage distribution points.

The natural water and the carbonated water, deriving from their respective sources and transported under pressure in the ducts 2 and 5, are kept cold by the refrigeration fluid circulating in the duct 10 and one or the other is tapped, corresponding to each mixing tap 13, according to the type of water required by the beverage being mixed. The simple rotation of the needle-valve 6 allows the type of water that flows to each tap to be changed, without the need to modify the layout of the inflow lines, or to carry out any welding or cutting, connecting or disconnecting operation.

Furthermore, the simple installation of the means of the hydraulic management of water and syrups, the ordered layout of the supply tubes and the use of rapid-fit bayonet-locking pipe fittings, make the new dispenser apparatus very practical and easy to maintain.

Obviously it is possible to provide mixing apparatuses, each having a block carrying the connections for multiple taps for the simultaneous dispensing of different beverages, with the capability of choosing between natural water and carbonated water for each of them, and of changing such choice immediately and without any intervention being made on the pipe connections.

The entire disclosure of all applications, patents and publications, cited above, and of corresponding European application No. 97830729.6, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

I claim:

1. An apparatus for dispensing beverages, of the "post-mix" type, which comprises at least one source of water, at least one reservoir containing syrup, mixing and dispensing taps and a hydraulic connection from the source of water and from the reservoir or reservoirs of syrup to the taps respectively, wherein said hydraulic connection comprises a shaped block in which is formed at least one longitudinal duct adapted to be linked to the source of water, at least two transversal ducts each adapted to be in fluid communication with a reservoir of syrup and each being in communication with said longitudinal duct and with a pipe fitting that communicates at least partially with said transversal duct and with one of said mixing and dispensing taps.

2. An apparatus for dispensing beverages according to claim 1, comprising a source of carbonated water and a source of natural water, characterized in that said block has at least one pair of said longitudinal ducts, linked to said sources of carbonated and natural water respectively, in fluid communication with said first transversal duct or ducts, and means for selectively controlling the passage of water from one or the other of said longitudinal ducts to each of said first pipe fittings.

3. An apparatus for dispensing beverages according to claim 2, characterized in that said means for selectively controllings the passage of water are in the form of a needle valve, fitted and rotating within each first transversal duct.

4. An apparatus for dispensing beverages according claim 1 characterized by comprising at least one third longitudinal duct for the circulation of refrigerant fluid.

5. An apparatus for dispensing beverages according to claim 3, characterized in that said needle-valve comprises an "L"-shaped duct presenting one aperture along the side surface, and an axial terminal aperture, lateral sealing gaskets and means for its axial rotation.

6. An apparatus for dispensing beverages according to claim 1 characterized in that said shaped block is produced in metallic or plastic material.

7. An apparatus for dispensing beverages according to claim 1 characterized in that said pipe fitting or fittings are of the rapid-fit bayonet-lock type, comprising one end shaped to fit into said transversal ducts, a second end shaped to fit into said corresponding mixing tap and circular sealing gaskets.

8. An apparatus for dispensing beverages according to claim 3, characterized in that said needle-valve comprises an "L"-shaped duct presenting one aperture along the side surface, and an axial terminal aperture, lateral sealing gaskets and means for its axial rotation.

9. An apparatus for dispensing beverages according to claim 8, characterized in that said pipe fitting or fittings are of the rapid-fit bayonet-lock type, comprising one end shaped to fit into said transversal ducts, a second end shaped to fit into said corresponding mixing tap and circular sealing gaskets.

10. An apparatus for dispensing beverages according to claim 9, characterized by comprising at least one third longitudinal duct for the circulation of refrigerant fluid.

11. An apparatus for dispensing beverages, of the "post-mix" type, which comprises a source of natural and a source of carbonated water, at least one reservoir containing syrup, one or more mixing and dispensing taps and a hydraulic connection from the source or sources of water and from the reservoir or reservoirs of syrup to the tap or taps respectively, wherein said hydraulic connection comprises a shaped block in which is formed a pair of longitudinal ducts, one of which is linked to the source of natural water, and the other of which is linked to the source of carbonated water, said longitudinal ducts and a pipe fitting, each being in communication with at least one transversal duct partially or totally with each of said transversal ducts and with said associated mixing and dispensing taps, and an arrangement for selectively controlling the passage of natural water or carbonated water from one or the other of said longitudinal ducts to each of said first pipe fittings.

12. An apparatus for dispensing beverages according to claims 11, characterized in that said means for selectively controlling the passage of water are in the form of a needle valve, fitted and rotating within each first transversal duct.

13. An apparatus for dispensing beverages according to claim 11, characterized by comprising at least one third longitudinal duct for the circulation of refrigerant fluid.

14. An apparatus for dispensing beverages according to claim 12, characterized in that said needle valve comprises an "L"-shaped duct presenting one aperture along the side surface, and an axial terminal aperture, lateral sealing gaskets and means for its axial rotation.

15. An apparatus for dispensing beverages according to claim 11, characterized in that said shaped block is produced in metallic or plastic material.

16. An apparatus for dispensing beverages according to claim 11, characterized in that said pipe fitting or fittings are of the rapid-fit bayonet-lock type, comprising one end shaped to fit into said transversal ducts, a second end shaped to fit into said corresponding mixing tap and circular sealing gaskets.

* * * * *